US005168739A

United States Patent [19]

Heitze

[11] Patent Number: 5,168,739

[45] Date of Patent: Dec. 8, 1992

[54] UPSETTING PRESS FOR REDUCING THE WIDTH OF ROLLING STOCK

[75] Inventor: Gerhard Heitze, Netphen, Fed. Rep. of Germany

[73] Assignee: SMS Schloemann Siemag Aktiengesellschaft, Dusseldorf, Fed. Rep. of Germany

[21] Appl. No.: 744,459

[22] Filed: Aug. 12, 1991

[30] Foreign Application Priority Data

Aug. 10, 1990 [DE] Fed. Rep. of Germany ..... 4025390

[51] Int. Cl.[5] ..... B21B 15/00

[52] U.S. Cl. ..... 72/184; 72/406; 72/407; 72/342.3; 384/291; 100/282

[58] Field of Search ..... 72/407, 406, 402, 450, 72/452, 184, 342.3; 100/282, 292; 384/155, 154, 291, 292, 293, 286; 74/587

[56] References Cited

U.S. PATENT DOCUMENTS

| | | | |
|---|---|---|---|
| 1,947,023 | 2/1934 | Shoemaker | 384/291 |
| 3,017,229 | 1/1962 | Dilworth | 384/291 |
| 3,122,033 | 2/1964 | Riemenschneider | 72/452 |
| 3,685,341 | 8/1972 | Karsnak | 72/450 |
| 4,105,267 | 8/1978 | Mori | 384/291 |
| 4,356,717 | 11/1982 | Okunishi | 72/342.3 |
| 5,077,999 | 1/1992 | Rohde | 72/406 |

FOREIGN PATENT DOCUMENTS

| | | | |
|---|---|---|---|
| 1141890 | 12/1962 | Fed. Rep. of Germany | 100/282 |
| 800533 | 7/1936 | France | 384/293 |
| 40633 | 2/1988 | Japan | 72/407 |
| 306035 | 12/1989 | Japan | 72/407 |
| 623748 | 9/1978 | U.S.S.R. | 100/282 |

*Primary Examiner*—Daniel C. Crane

*Attorney, Agent, or Firm*—Anderson Kill Olick & Oshinsky

[57] ABSTRACT

In an upsetting press for reducing the width of rolling stock, particularly the slab width in hot-rolled wide strip roughing mills with tool carriers, which are disposed on either side of the slab edge, accommodate pressing tools and can be moved in the direction of reducing the slab with the help of a steering system, which is operated with the help of at least one crank gear, the connecting rod head of the crank gear is movably supported in an appropriately shaped pressure pan of the tool support and the connecting rod head has a sliding band with hydrostatic pressure lubrication, which corresponds at least to the length of the contact of the pressure pan, so that the highly loaded sliding surfaces between the connecting rod head and the pressure pan are adequately lubricated with grease, even if they move only slightly relative to one another.

6 Claims, 3 Drawing Sheets

UPSETTING PRESS FOR REDUCING THE WIDTH OF ROLLING STOCK

BACKGROUND OF THE INVENTION

The invention relates to an upsetting press for reducing the width of rolling stock, and particularly to a press for reducing the slab width in hot-rolled wide strip roughing mills with tool carriers, which are disposed on either side of the slab edge, accommodate pressing tools and can be moved in the direction of reducing the slab with the help of a steering system, which is operated by at least one crank gear.

The German Offenlegungsschrift 25 31 591 discloses an upsetting press for reducing the width and thickness of slabs of different width, which are supplied by a continuous plant. The slab is processed repeatedly in the upsetting press with pressure tools that are moved against one another. The pressure tool is able to follow the advance of the slab freely and the tools are operated so that they carry out a relatively slow working sequence and a relatively rapid idle motion. The upsetting press has a pair of edge processing tools which act vertically upon the edges of the slab, as well as means for moving the tools back and forth rapidly. The tools are held in a tool support, which is moved by a crank gear, and are pivoted at the tool carrier with pivot pins. The upsetting forces, required for reducing the width of the slab, must be transferred from the pivot pin support to the tool carrier and onto the pressure tool. The resulting high frictional forces consequently reduce the output of the press and the high attrition of the pivot pins increases the maintenance costs and decreases the availability not only of the upsetting press, but also of the whole rolling mill, into which the press is tied.

In the flying upsetting press of German patent P 39 17 398.4, pressing tools, which are accommodated in tool supports, are disposed in hot-rolled wide strip roughing mill on both sides of the slab edge in order to reduce the width of slabs. To form a reduction drive, each pressing tool is moved with the associated tool support, with the help of a steering system operated by a crank gear, in the direction of a width reduction of the slab, the crank gear being disposed in a crankcase. The crank gear consists of two driven eccentric shafts, and a connecting rod is mounted on each eccentric shaft. The head of the connecting rod is in operative connection with the tool support for the transfer of upsetting forces. A feed driving mechanism, which acts essentially in the direction in which the slab is fed, engages the tool support. By means of these measures, the course of the motion of the pressing tools can be controlled separately for reducing pressing and for advancing the pressing tools. In the event that the feed driving mechanism is constructed as a hydraulic cylinder, the positioning motion of the hydraulic cylinder can be controlled in a particularly advantageous manner in the form of a path-time function so that, for an advance of any magnitude, the synchronization between the motion of the pressing tool and the motion of the slab that is to be pressed laterally is ensured. During the pressing process, the connecting rod is moved angularly only through a fraction of a degree by the appropriate controlling mechanism of the feed cylinder and through only a few degrees during the idling phase, so that an effective build-up of lubricant can be brought about in the bearing of the head of the connecting rod.

SUMMARY OF THE INVENTION

Starting out from the upsetting press of Patent P 39 17 398.4, it is the object of the present invention to provide an upsetting press in which the bearing of the connecting rod and tool support is constructed so that a highly effective and reliable lubrication of the connecting rod is ensured even when the upsetting forces are very high and the angular displacement of the connecting rod is very small.

Pursuant to this object, and others which will become apparent hereafter, one aspect of the present invention resides in an upsetting press of the aforementioned type in which the head of the connecting rod of the crank gear is movably supported on bearings in an appropriately shaped pressure pan. The head of the connecting rod is provided with a sliding band with hydrostatic pressure lubrication, which corresponds at least to the contact length of the pressure pan. This arrangement assures that, even at very large upsetting forces, the surface pressures between the connecting rod and the tool support remain manageable and a stable lubricating film is ensured even for very small angular movements of the connecting rod. The disposal of the sliding band at the head of the connecting rod is a further prerequisite for the stable lubricating film between the head of the connecting rod and the pressure pan, since the sliding band can be produced with a surface of very high quality. Because of the size of the connecting rod head, such a high surface quality is hardly possible when such a head is machined directly with conventional machine tools.

For the advantageous refinement of the connecting rod lubrication, provisions are furthermore made so that the sliding band has lubrication bore reliefs, which are distributed approximately uniformly on the surface facing the pressure pan and into which grease passages, which are passed through the connecting rod of the crank gear, discharge. The uniform distribution of the lubrication bore reliefs on the surface of the sliding band brings about a uniform supply of lubricant, which commences increasingly above all, when the upsetting pressure on the connecting rod is relieved. The grease pump, which has been proposed as being advantageous in this connection and produces a permanent pressure, forces the lubricating grease through the passages to the lubricating bore reliefs during the pressureless phase of the motion of the connecting rod with such high pressures, that the pressure pan of the tool support is lifted by differentially small amounts from the head of the connecting rod and lubricating grease is forced from the lubricating bore reliefs two-dimensionally between the sliding band and the bearing shell of the pressure pan.

In a further embodiment, which improves the supply and distribution of the lubricant, the lubricating bore reliefs are cross-shaped lubricating grooves at least in the pressure angle of about 45° to both sides of a connecting line between the crank gear bearing and the connecting rod head bearing.

In accordance with a further embodiment of the connecting rod lubrication of the crank gear, the tool support is provided with a cooling system in the region of the pressure pan, so that the viscosity of the lubricating grease can be controlled at specified values at the large upsetting pressures and the high operating temperatures that are to be expected, and so that the lubricating film is not thinned to the extent, that there is danger of damage to the thrust bearing shell or to the sliding band. So that the lubricating film cannot be harmed by insufficient surface machining of the sliding band, it is furthermore proposed that the peak-to-valley height roughness Ra of the surface of the sliding band facing the pressure pan does not exceed a value of 0.2μ. This means that a mirror surface should be ground on the sliding band. In conjunction with a thrust bearing shell of bronze for the pressure pan of the tool support and the aforementioned cooling system of the pressure pan, a grease lubrication of the connecting rod head of the crank gear can be achieved, which is capable of handling the highest stresses.

So that the pressure pan cooling system can be particularly effective over the entire contact area between the pressure pan and the connecting rod head, this cooling system consists of coolant ducts, which meander in the tool support below the thrust bearing shell, extend over the width of the latter and have connecting openings for the inflow and outflow of the coolant disposed in each case at one end of the thrust bearing shell. By appropriately controlling the flow of the coolant through the ducts, a bearing temperature and, with that, a particular viscosity of the lubricating grease, which has been determined previously mathematically or by experiment, can be maintained precisely.

In still another embodiment of the invention, facilities for collecting and drawing off the overflow of grease, that is, that grease, which penetrates slowly during the operation of the upsetting press between sliding surfaces to the outside, are disposed in the end regions of the thrust bearing shell and sliding band. The amount of grease overflow is replaced quantitatively by the grease pump through the grease passages and into the lubricating bore reliefs and, from there, reaches the sliding surfaces, as described above.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
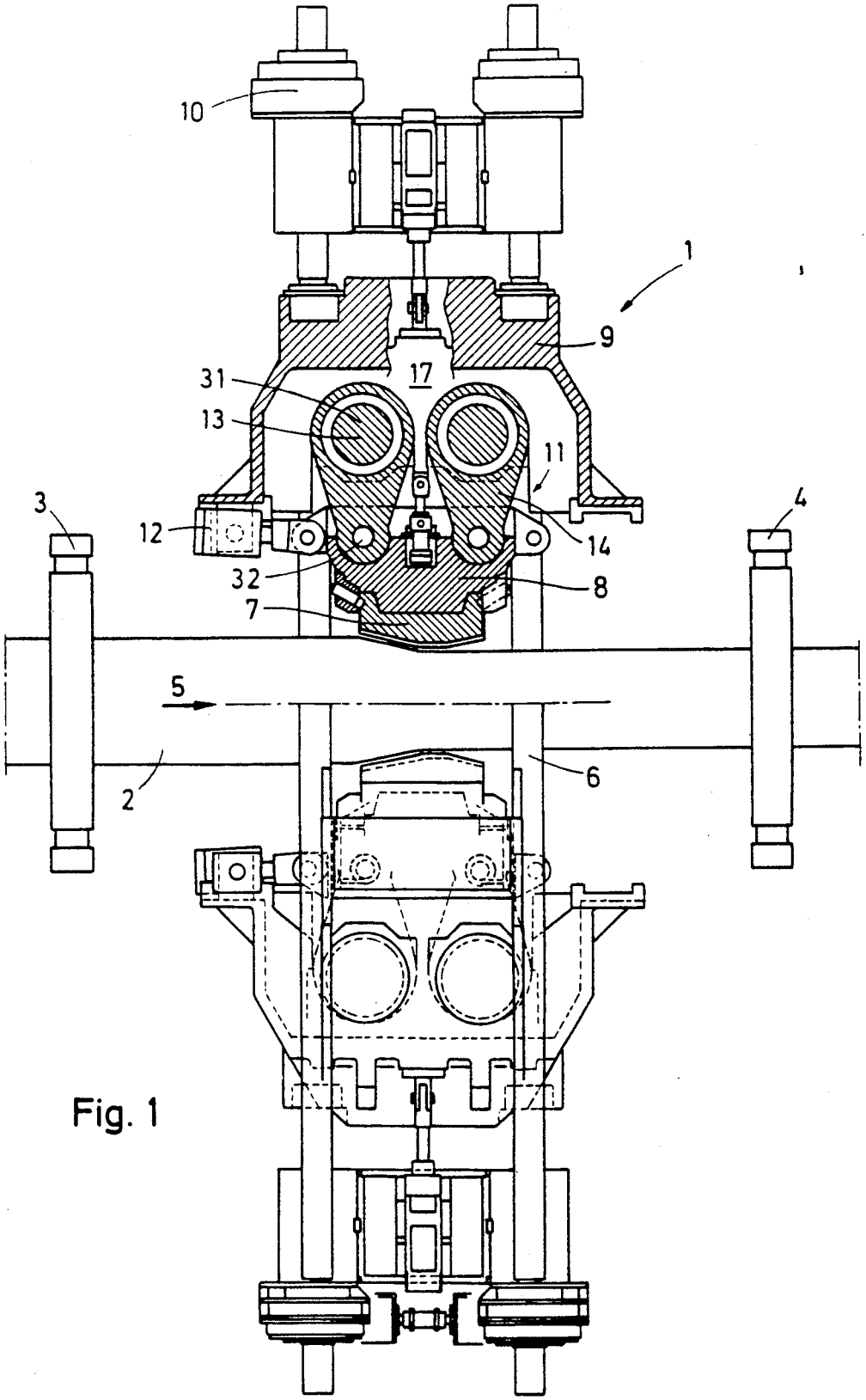
FIG. 1 is a horizontal section through an upsetting press pursuant to the present invention.

FIG. 1 shows a horizontal section through the flying upsetting press 1 for reducing the width of slabs 2 in a hot-rolled wide strip roughing mill. The slabs are supplied almost continuously from a slab casting installation, the details of which are not shown and which precedes the upsetting press, respectively. The driver rolls 3, 4 are disposed before and after the upsetting press, respectively. The slab 2 passes though the slab upsetting framework in the direction of motion 5. The upsetting press has supports 6. A crankcase 9 is adjustably guided in the frame support of the upsetting press. The crankcase 9 is adjusted with the help of a mechanical adjustment device 10. However, a hydraulically acting piston/cylinder construction can also be used as adjusting device.

Pressing tools 7 in tool supports 8 are disposed on either side of the slab 2. The pressing tool and the tool support have a reduction drive 11, which acts in the normal direction, that is, perpendicularly to the slab 2, and a feed drive 12, which acts in the tangential direction, that is, parallel to the slab 2. The reduction drive 11 is formed so that each tool support 8 is movable with the help of a steering system, which is operated by two eccentric shafts 13 and contains two connecting rods 14, essentially in the direction of the slab, which is to be reduced in width. The feed drive 12, which acts essentially in the direction in which the slab 2 is fed, acts upon the tool support 8 and is supported at the crankcase 9, in which the two eccentric shafts 14 are supported. The head 15 of the connecting rod 14 is movably supported in an appropriately shaped pressure pan 16 of the tool support 8.

Figure 2:
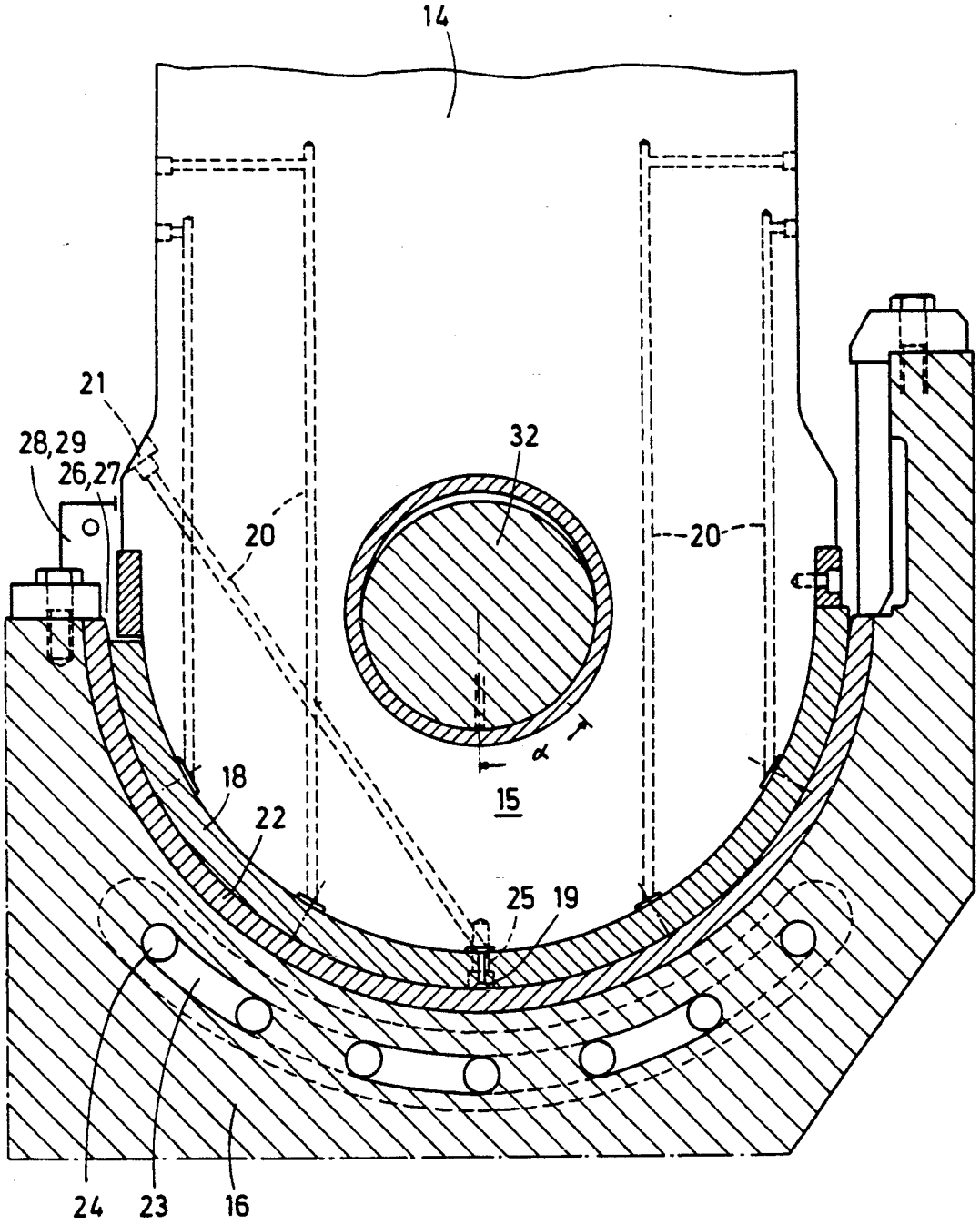
FIG. 2 shows the connecting rod head with the sliding band and the cooled pressure pan in the tool support, on an enlarged scale.

FIG. 2 shows, on a highly enlarged scale, the connecting rod head 15 of the crank gear 17, which is formed from the eccentric shafts 13 and which is movably supported in an appropriately shaped pressure pan 16 of the tool support 8. The connecting rod head 15 has a sliding band 18 with hydrostatic pressure lubrication, which corresponds at least to the length of contact of the pressure pan 16. On its surface facing the pressure pan 16, the sliding band 18 has approximately uniformly distributed lubricating bore reliefs 19, into which grease passages 20 discharge, which are passed through the connecting rod 14 of the crank gear 17. Grease pipelines, which are not shown in greater detail and are connected to a grease pump, which permanently produces pressure, can be connected to the inlet borehole 21 of the grease passages 20. The pressure pan 16 in the tool support 8 is provided with a thrust bearing shell 22 of a bronze-containing material. Below the thrust bearing shell, meandering coolant ducts 23, which in each case have the connecting opening for the inflow and the outflow of the coolant at one end of the thrust bearing shell 22, are disposed over the width of the thrust bearing shell 22. The surface of the sliding band 18, which faces the pressure pan 16, is finely ground, so that the peak-to-valley height roughness of the surface does not exceed a value of 0.2μ. The sliding band 18 is connected by means of screws 25 with the connecting rod head 15 and additionally has an adhesive joint. In the end region 26, 27 of the thrust bearing shell 22 and the sliding band 18, collecting arrangements 28, 29 are disposed for collecting and drawing off the overflow of grease.

Figure 3:
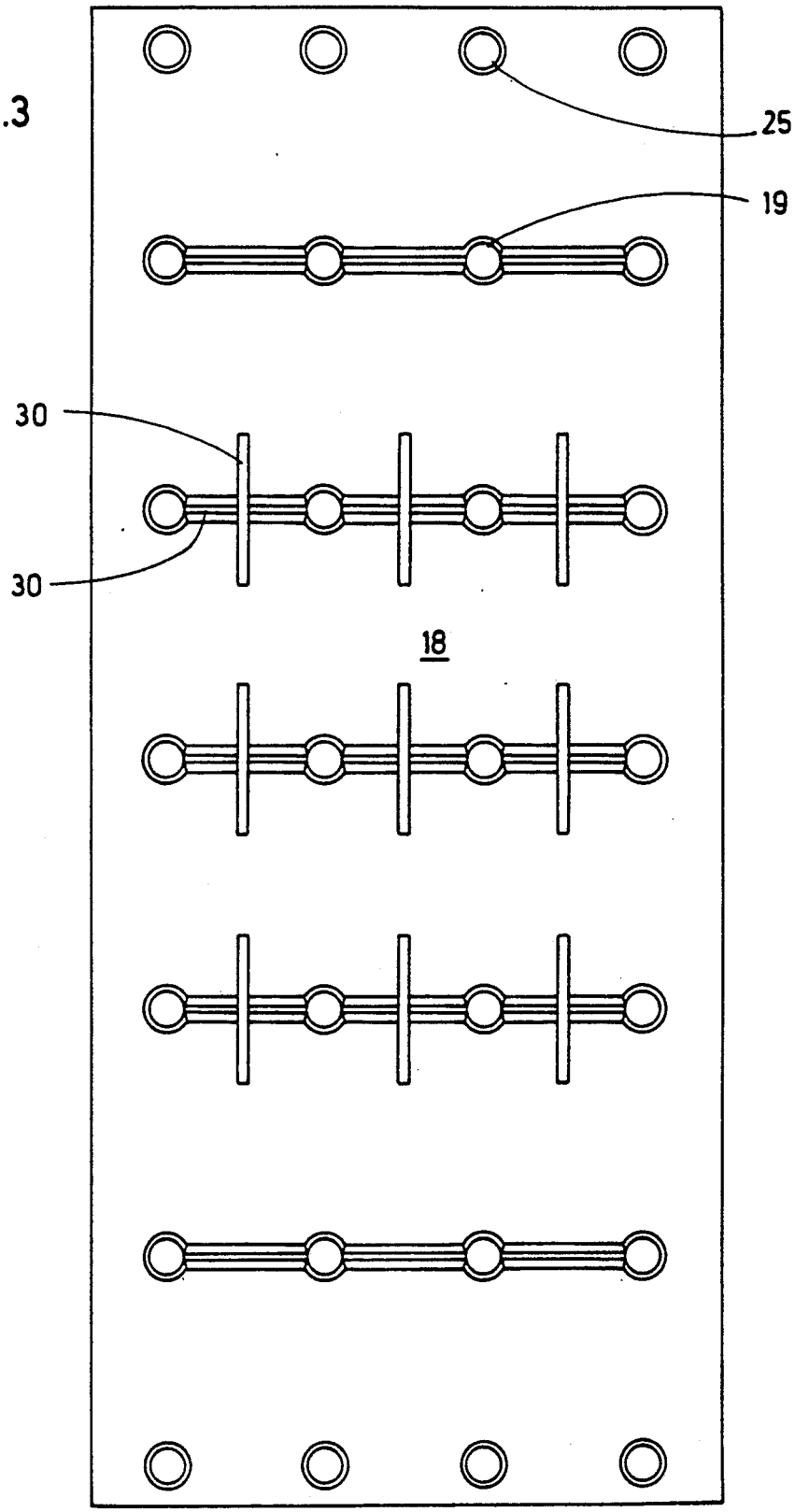
FIG. 3 shows a plan view of the uncoiled sliding band.

FIG. 3 shows the plan view of the uncoiled sliding band 18, on the surface of which uniformly distributed lubrication bore reliefs 19 are disposed, into which the grease passages 20, which are passed through the connecting rod 14 of the crank gear 17, discharge. In the region of a pressure angle of about 45° to both sides of a connecting line between the crank gear bearing 31 and the connecting rod head bearing 32, the lubricating bore reliefs are cross-shaped lubricating grooves 30.

The measures described above ensure that the highly loaded sliding surfaces between the head of the connecting rod and the pressure pan of the crank gear, even when these move slightly relative to one another, receive adequate lubrication, the thickness of the lubricating film of which under operating conditions can be held between values of 5 and 15μ, so that the layer of grease can be reduced to relatively small values. Due to the interaction between the mirror-smooth, ground sliding band and the accurate metering out of the grease as well as the controllable grease viscosity resulting from the additional water cooling of the pressure pan, a satisfactory, bearing, lubricating film can be ensured between the sliding surfaces and a low grease consumption can be achieved, because the displacement time of the grease from the sliding surfaces to the collecting device is prolonged by these means.

While the invention has been illustrated and described as embodied in an upsetting press for reducing the width of rolling stock, it is not intended to be limited to the detailes shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An upsetting press for reducing slab width of rolling stock in hot-rolled wide strip roughing mills as the slab moves through the upsetting press, comprising:

tool supports disposed on either side of the slab, which accommodate pressing tools and are movable in a direction towards and away from one another for reducing the slab;

a steering system for moving the tool supports to effect the slab reduction, the steering system being operated by at least one crank gear, the crank gear (17) having a connecting rod with a connecting rod head (15) that is movably supported in an appropriately shaped pressure pan (16) of the tool support (8), said pressure pan (16) forming in-part said tool support (8);

a sliding band (18) with hydrostatic pressure lubrication provided on the connecting rod head (15), the sliding band (18) having a length that corresponds to at least the length of contact area of the pressure pan (16) and the connecting rod head (15), the sliding band (18) having a surface that faces the pressure pan (16) and is provided with approximately uniformly distributed lubricating bore reliefs (19) into which grease passages (20), which pass through the connecting rod (14) of the crank gear (17), discharge, the pressure pan (16) being provided with cooling means for cooling of the pressure pan (16); and a thrust bearing shell (22) arranged between the pressure pan (16) and the connecting rod head (15) so that the sliding band (18) slidably engages the thrust bearing shell (22), the pressure pan cooling means including cooling ducts (23) that meander in the pressure pan (16) below the thrust bearing shell (22) and extend over the width of said shell, the cooling ducts (23) having connecting openings (24), which are disposed at one end of the thrust bearing shell (22), for an inflow and outflow of a coolant.

2. The upsetting press of claim 1, and further comprising a crank gear bearing (31) and a connecting rod head bearing (32), the lubricating bore reliefs (19) being cross-shaped lubricating grooves 30 at least in a pressure angle of 45° to both sides of a connecting line between the crank gear bearing (31) and the connecting rod head bearing (32).

3. The upsetting press of claim 1, and further comprising a grease pump which permanently produces pressure, the grease passages (2) being connected to the grease pump.

4. The upsetting press of claim 1, wherein the sliding band (18) has a surface that faces the pressure pan (16), said band surface having a roughness that does not exceed a peak-to-valley height value Ra of $0.2\mu$.

5. The upsetting press of claim 1, wherein the sliding band (18) is connected to the connecting rod head (15) by a screw and adhesive connection (25).

6. The upsetting press of claim 1, and further comprising means (28, 29) provided in end regions (26, 27) of the thrust bearing shell (22) and the sliding band (18) for collecting and drawing off an overflow of grease.

* * * * *